US008267668B2

(12) United States Patent
Nation et al.

(10) Patent No.: US 8,267,668 B2
(45) Date of Patent: Sep. 18, 2012

(54) FUEL PUMP MOTOR USING CARBON COMMUTATOR HAVING REDUCED FILMING

(75) Inventors: Thomas C. Nation, Canton, MI (US); Stephen T. Kempfer, Canton, MI (US); James Knight, Ypsilanti, MI (US); James L. Thompson, Ypsilanti, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 1607 days.

(21) Appl. No.: 11/328,408

(22) Filed: Jan. 9, 2006

(65) Prior Publication Data

US 2006/0275135 A1 Dec. 7, 2006

Related U.S. Application Data

(63) Continuation-in-part of application No. 11/142,587, filed on Jun. 1, 2005.

(51) Int. Cl.
*F04B 49/06* (2006.01)

(52) U.S. Cl. ..... 417/45

(58) Field of Classification Search ..... 417/12, 417/44.01, 326; 134/39; 310/62, 63; 123/495
See application file for complete search history.

(56) References Cited

U.S. PATENT DOCUMENTS 3,969,044 A * 7/1976 Fussner et al. ..... 417/410.4
4,418,669 A * 12/1983 Johnson et al. ..... 123/436
5,092,302 A * 3/1992 Mohan ..... 123/497
5,672,051 A * 9/1997 Forgue et al. ..... 417/44.11
6,868,826 B1 * 3/2005 Oono ..... 123/339.1
2002/0140313 A1 10/2002 Noya et al.

FOREIGN PATENT DOCUMENTS

WO WO 2004018118 A2 * 3/2004

OTHER PUBLICATIONS

Shimoda et al,A study on commutatiom arc and wear of brush in gasoline of DC motors,IEEE HOLM conf,Electrical contacts,Sep. 1993,pp. 151-156.*

* cited by examiner

*Primary Examiner* — Devon Kramer
*Assistant Examiner* — Amene Bayou
(74) *Attorney, Agent, or Firm* — Raymond L. Coppiellie; MacMillan, Sobanski & Todd, LLC

(57) ABSTRACT

A fuel pump system for pumping fuel to an engine in a vehicle includes a pump motor having a carbon-based commutator and brushes in a position exposed to fuel, resulting in a tendency to form a film between the commutator and brushes that can reduce pump performance by increasing the electrical resistance of the brush-commutator interface. The pump motor has a nominal voltage rating. A power circuit is coupled to the pump motor for selectably providing an operating voltage and a boost voltage, wherein the boost voltage is greater than the nominal voltage rating. A controller selecting the operating voltage during an ordinary run cycle and selects the boost voltage during a clean-up cycle. The controller selects the clean-up cycle for a limited time that is sufficiently short to avoid damage to the pump motor from exceeding the nominal voltage rating and sufficiently long to create arcing between the commutator and brushes that reverses formation of the film.

17 Claims, 3 Drawing Sheets

FUEL PUMP MOTOR USING CARBON COMMUTATOR HAVING REDUCED FILMING

CROSS REFERENCE TO RELATED APPLICATIONS

This application is a continuation-in-part of U.S. application Ser. No. 11/142,587, filed Jun. 1, 2005, entitled "Fuel Pump Boost System."

STATEMENT REGARDING FEDERALLY SPONSORED RESEARCH

Not Applicable.

BACKGROUND OF THE INVENTION

The present invention relates in general to electric fuel pumps, and, more specifically, to reducing films that build-up on carbon-based commutators and brushes during exposure to fuel.

One conventional type of automotive fuel pump uses an electric motor immersed in the fuel inside a pump housing to drive an impeller or a roller mechanism to pump fuel from a fuel tank to an engine in a vehicle. Fuel flowing through the motor advantageously cools the motor during operation. By not sealing the motor components from the fuel, a more inexpensive and compact pump design is achieved.

The pump motor typically comprises a DC motor having a commutator and brushes for coupling current to armature coils. Efficient coupling of current between the brushes and commutator depends on maintaining robust contact between them. The contact of fuel with the brush-commutators, however, results in the buildup of various high resistance materials on the brush-commutator interface referred to as filming. The increased resistance of the connection between the brushes and commutator reduces current flow to the armature thereby reducing the flow rate through the pump. The reduced flow rate impacts engine performance and may require a pump to be replaced.

The rate at which filming occurs may vary depending upon the type of fuel present. Modern vehicles are typically exposed to various grades and types of fuel. Ethanol/gasoline blends such as E10 fuel may have a particularly high rate of filming. As these fuels are increasingly used, the problem of filming is becoming more urgent.

The rate of filming also depends upon the material used for constructing the brush and the commutator. One traditional commutator material has been copper. Although copper is less susceptible to film formation than some other materials, the surface of the copper wears away at an undesirably high rate. While the wearing away of the copper surface is probably responsible for the lower amount of filming, the premature wearing away of the commutator provides a shortened service life of the pump motor. Thicker commutator pads could provide greater lifetime, but would undesirably increase the length and mass of the armature thereby decreasing efficiency. Fuel pump brushes typically have been and continue to be made of carbon and carbon-based materials.

More recently, carbon-based materials have been used for commutators because of their increased wear resistance. These carbon-based materials may include sintered carbon or carbon mixed with resins or other materials. A disadvantage of the carbon-based materials is an increased susceptibility to buildup of a filming layer. One solution has been to apply various coatings to the commutator and/or brush comprising a material more resistant to buildup of the filming layer. However, these measures have resulted in significantly increased costs of materials and cost of manufacture. Therefore, it would be desirable to reduce filming without requiring special materials or manufacturing processes.

SUMMARY OF THE INVENTION

The present invention avoids the lowering of pump performance and the increase of impedance from brush-commutator filming by operating the pump motor at a voltage boost over its nominal voltage rating for brief periods to clear the film as a result of arcing.

In one aspect of the invention, a fuel pump system pumps fuel to an engine in a vehicle. A pump motor includes a carbon-based commutator and brushes in a position exposed to fuel, resulting in a film forming between the commutator and brushes. The pump motor has a nominal voltage rating. A power circuit is coupled to the pump motor for selectably providing an operating voltage and a boost voltage, wherein the boost voltage is greater than the nominal voltage rating. A controller selects the operating voltage during an ordinary run cycle and selects the boost voltage during a clean-up cycle. The controller selects the clean-up cycle for a limited time that is sufficiently short to avoid damage to the pump motor from exceeding the nominal voltage rating and sufficiently long to create arcing between the commutator and brushes that reverses formation of the film.

DETAILED DESCRIPTION OF PREFERRED EMBODIMENTS

Figure 1:
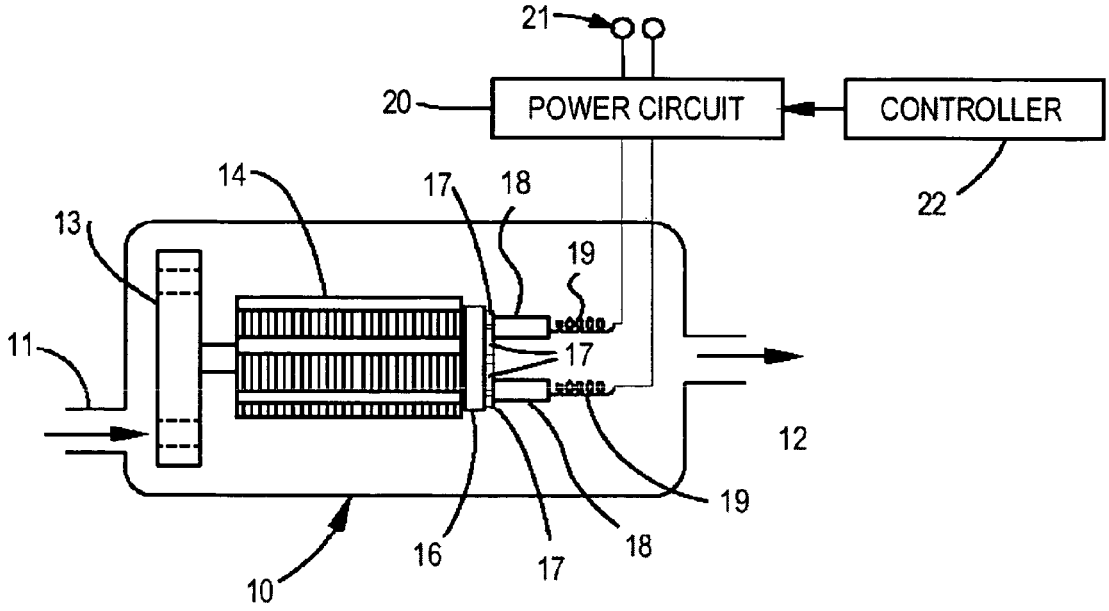
FIG. 1 is a diagrammatic view of certain elements of a fuel pump system according to one aspect of the invention.

Referring now to FIG. 1, an electric fuel pump 10 has an inlet 11 for receiving fuel within a fuel tank and an outlet 12 for connecting to a fuel line to a fuel rail or fuel injectors of a vehicle engine. A pumping chamber 13 containing an impeller is connected to a motor armature 14. A commutator 16 is mounted to the opposite end of armature 14 and has commutator bars 17 disposed thereon. Commutator bars 17 are in mechanical contact with brushes 18 under the influence of springs 19 for maintaining the close contact of brushes 18 with commutators 17. Brushes 18 are electrically connected to a power circuit 20. Power circuit 20 receives electrical power at terminals 21 and operates according to a control signal received from a controller 22.

Figure 2:
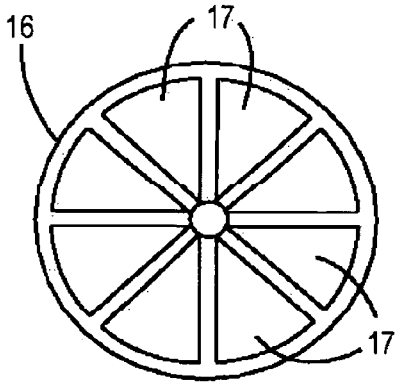
FIG. 2 is a front plan view of the commutator shown in FIG. 1.
Figure 3:
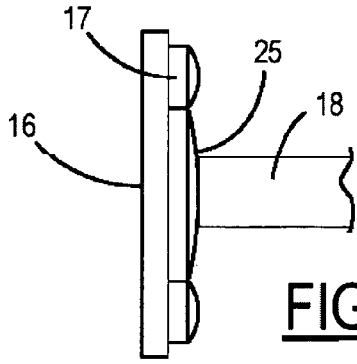
FIG. 3 is a side view of the commutator of FIG. 2 with the presence of filming.

FIG. 2 shows a front view of commutator bars 17 on commutator 16. FIG. 3 is a side view showing a filming layer 25 that has built up between commutator bars 17 and brushes 18.

In accordance with the present invention, it has been found that boosting the voltage supplied to the fuel pump motor to a sufficiently high voltage can reverse (i.e., either reduce or remove) the filming action. The boosted voltage results in electrical arcing between the commutator bars and brushes which removes the film and restores their electrical conductivity. Since the higher voltage level to be used is greater than what is desirable for typical pump operation, the present invention employs a clean-up cycle that is periodically initiated for very limited times so that the filming is minimized to a sufficient extent.

Figure 4:
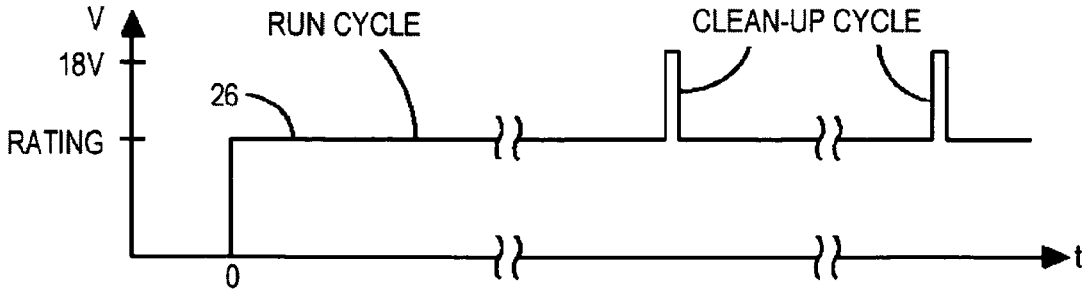
FIG. 4 plots voltage supplied to a pump motor in one embodiment of the invention during an ordinary run cycle and a clean-up cycle.

FIG. 4 shows a voltage waveform 26 which is applied to a fuel pump motor according to one preferred embodiment of the invention. The pump motor has a nominal voltage rating dictated by its particular design. The nominal voltage rating is indicated on the vertical axis in FIG. 4 and may have a value of about 13 volts for a typical automotive fuel pump. Waveform 26 shows that at time t=0 which coincides with the vehicle being started (i.e., turning on of an ignition key), the pump voltage rises from zero to a normal operating voltage, wherein the normal operating voltage is less than or equal to about the nominal voltage rating of the motor. The power circuit provides this normal operating voltage to the pump motor to implement an ordinary run cycle of the pump for providing normal pump output. The ordinary run cycle could also include operating regimes wherein the motor voltage is modulated to lower levels in order to reduce the amount of fuel flow, as is known in the art.

In order to periodically reverse the filming on the brush-commutator interface, one or more clean-up cycles are provided wherein a boosted voltage is supplied to the pump motor by the power circuit. The boost voltage is greater than the nominal voltage rating and may preferably be in the range from about 16 to 20 volts. The power circuit provides the boost voltage during a clean-up cycle for a limited time that is sufficiently short to avoid damage to the pump motor from exceeding the nominal voltage rating and is sufficiently long to create arcing at the brush-commutator interface that reverses formation of the film. The actual boost voltage level and the length of time that the voltage is boosted can be optimized for different brush and commutator materials, different pump speeds, different motor currents, types of vehicle operation, type of fuel, and other factors. By way of example, a pump having a nominal voltage rating of 13 volts that has been operated in E10 fuel for 1,000 hours can have the resulting film almost completely removed by running the pump motor at 16 volts for about 90 seconds.

There are many potential ways of obtaining an appropriate frequency of clean-up cycles to keep filming in check while simultaneously avoiding motor damage from excessive boost voltages. For example, the clean-up cycle may occur once during each time a vehicle is operated (i.e., between engine starting and stopping) and have a duration of about 90 seconds. Alternatively, the clean-up cycle may occur several times during a driving session such that each individual clean-up cycle may have a duration between about 5 to 10 seconds. To minimize the risk of motor damage, it may be preferable to limit the occurrence of boost cycles during any particular intervals (e.g., one driving session or a period of 24 hours) to less than or equal to about 90 seconds.

Figure 5:
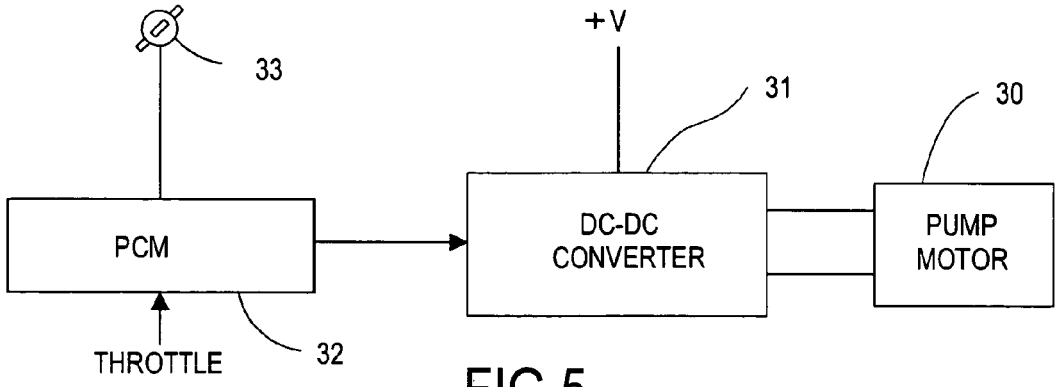
FIG. 5 is a block diagram of one embodiment of the invention utilizing a powertrain controller to control the timing of the clean-up cycle.

One concern related to fuel pump operation at a higher voltage concerns the increased noise output from the fuel pump that may be audible to occupants of the vehicle. In order to mask the added noise, it may be preferable to conduct the clean-up cycle during times of other increased noise from the engine such as during a hard acceleration. Accordingly, FIG. 5 illustrates an embodiment wherein pump motor 30 is driven by either an operating voltage or a boost voltage as provided by a DC-DC converter 31. A powertrain control module (PCM) 32 is connected to DC-DC converter 31 for selecting either the normal operating voltage or the boost voltage as appropriate. PCM 32 is connected to an ignition switch 33 for determining when the key of the vehicle is on (i.e., in the accessory, run, or start position). PCM 32 is also connected to many other sensors and input control elements such as a throttle for determining engine operation. When the key is on, PCM 32 activates DC-DC converter 31 to convert a regulated vehicle system voltage +V to the normal operating voltage of pump motor 30. One known typical pump motor has a nominal voltage rating of 13.2 volts, in which case the regulated vehicle voltage of about 14 volts may be converted by DC-DC converter 31 to an operating voltage of about 13.2 volts.

In response to information relating to the throttle position and other factors, PCM 32 detects whether a sufficiently large acceleration of the vehicle is taking place so that sufficient engine noise is present to mask the added fuel pump noise to conduct a clean-up cycle. In response to detection of such an acceleration event, PCM 32 commands DC-DC converter 31 to generate the boost voltage which may be in the range of about 16-20 volts.

Figure 6:
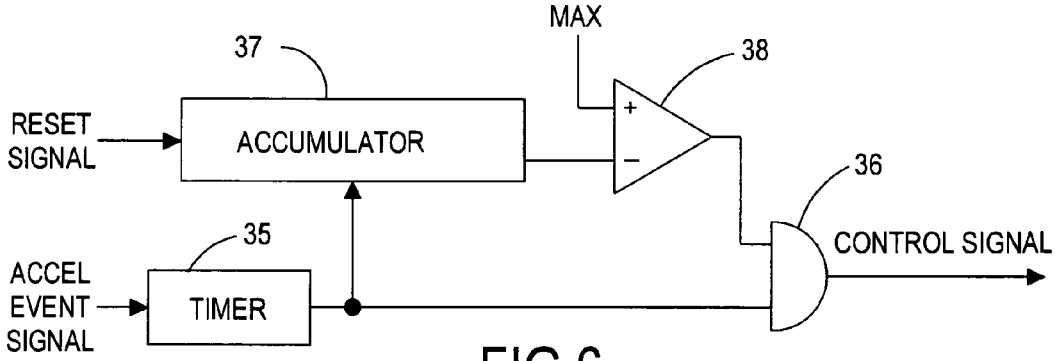
FIG. 6 is a block diagram of a logic circuit for controlling the clean-up cycle according to another embodiment.

FIG. 6 shows in greater detail a control circuit for generating a control signal to limit the times that a clean-up cycle may be performed during any particular time interval (such as a 24 hour period). An acceleration event signal as determined by the PCM is provided to a timer 35 for measuring the limited time for an individual clean-up cycle, preferably less than about 10 seconds. A high logic level signal from timer 35 determining the limited time for an individual clean-up cycle is provided to one input of an AND gate 36. The timer output signal is also provided to an input of an accumulator 37 which keeps a running total of the durations of clean-up cycles over a predetermined interval. The predetermined interval is defined by consecutive reset signals provided to accumulator 37. The reset signal may be obtained from a clock in the PCM for measuring a predetermined interval such as 24 hours, for example. The accumulated total time of all clean-up cycles during the current interval is provided from accumulator 37 to an inverting input of a comparator 38. The non-inverting input of comparator 38 receives a threshold signal defining a maximum amount of time for conducting clean-up cycles during the predetermined interval. The maximum threshold and the predetermined interval between reset signals are coordinated in order to insure that the limited time for the clean-up cycles are sufficiently short during the predetermined interval to avoid damage to the pump motor while being sufficiently long to reverse formation of the film. For example, a maximum threshold of 90 seconds during a predetermined interval of 24 hours may be appropriate depending upon brush and commutator size, dimension, and materials and other factors. Each individual clean-up cycle is sufficiently short (e.g., less than 10 seconds) in order to prevent obsessive heating or other stresses when operating the motor over its nominal voltage rating.

The output of inverter 38 provides a high logic level signal to the remaining input of AND gate 36 unless the accumulated amount exceeds the maximum. Thus, AND gate 36 functions as a transmission gate for the timer signal until the repeated periods of the clean-up cycle have accumulated to the maximum during the predetermined interval.

Figure 7:
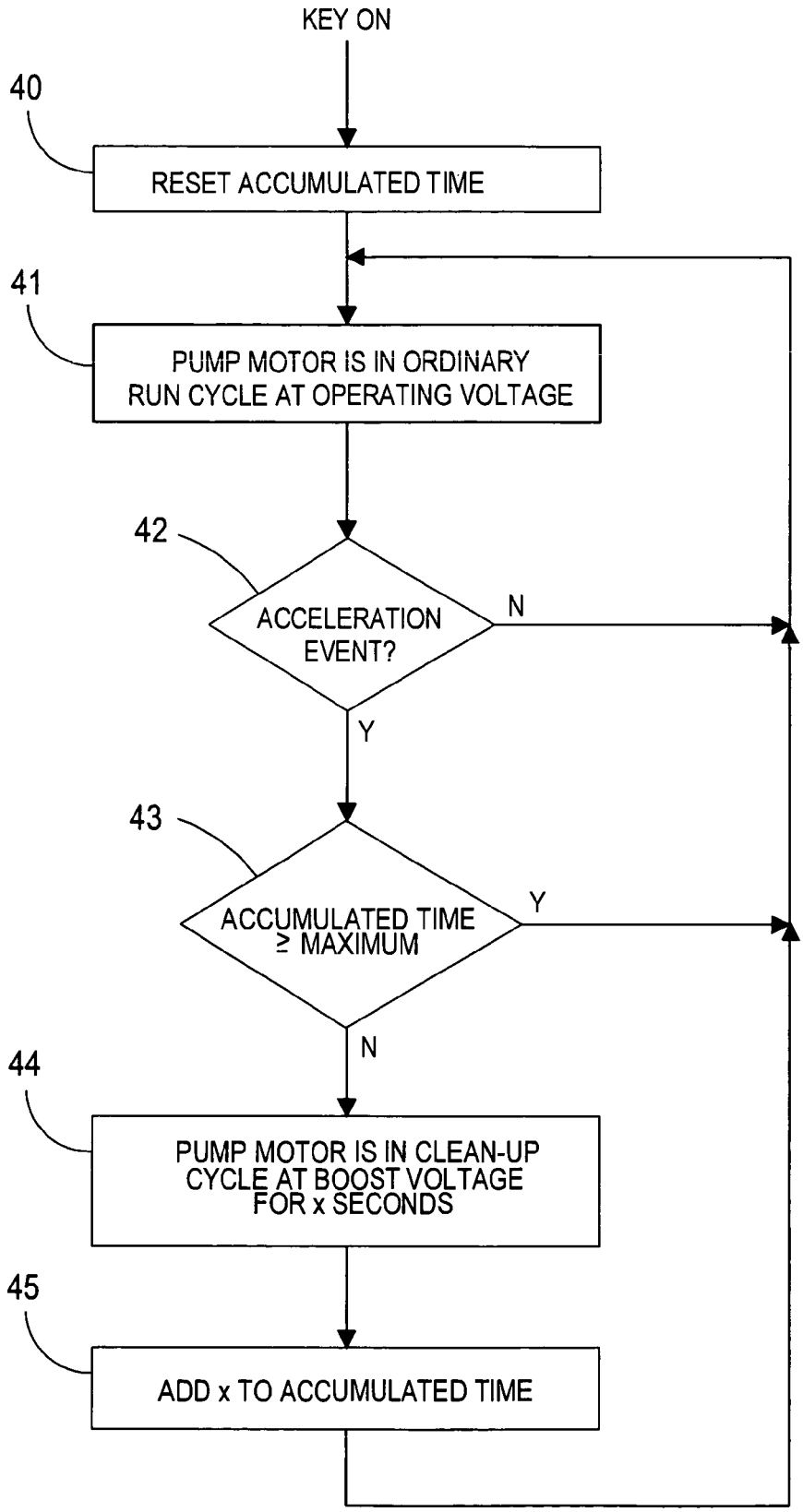
FIG. 7 is a flowchart showing yet another method of controlling the clean-up cycle.

A method according to another embodiment is shown in FIG. 7. In this embodiment, the predetermined interval corresponds with a driving cycle from the time a vehicle is started, driven, and turned off. When the ignition key is turned on, the accumulated time is reset in step 40. In step 41, the pump motor is run in its ordinary run cycle at its normal operating voltage. A check is made in step 42 to determine whether an acceleration event is in progress. If not, then the pump motor continues to run in the ordinary run cycle in step 41. If an acceleration event is detected, then a check is made in step 43 to determine whether the accumulated time is greater than or equal to the maximum allowed time. If it is, then a return is made to step 41 for continuing to run the pump motor in its ordinary run cycle. Otherwise, the pump motor is put into its clean-up cycle at the boost voltage in step 41 for a predetermined number seconds (designated as x seconds). In step 45, the amount x is added to the accumulated time and after the current clean-up cycle time expires a return is made to step 41 to return the pump motor to its ordinary run cycle.

Figure 8:
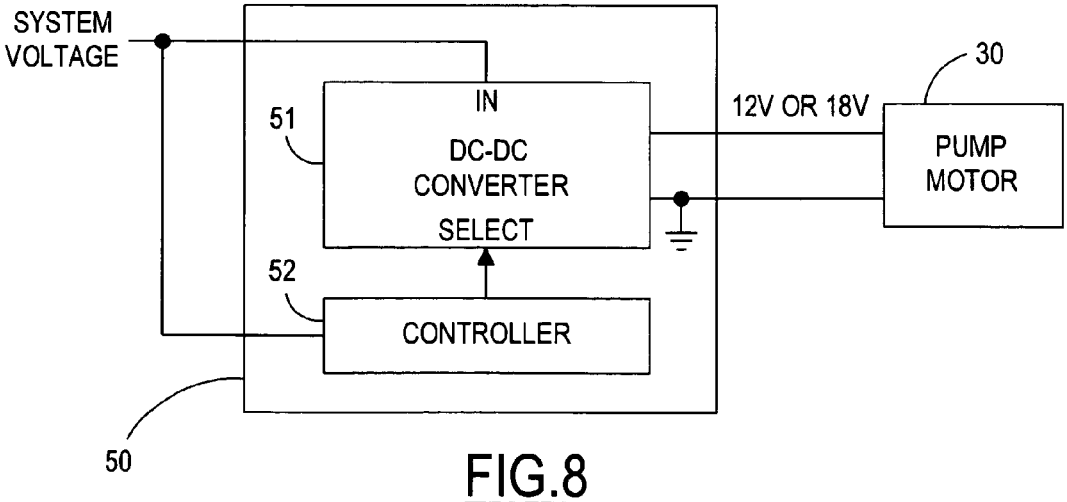
FIG. 8 is a block diagram according to another embodiment wherein a controller may be integrated with a DC-DC converter to supply appropriate voltages to the pump motor.

FIG. 8 shows yet another embodiment for generating clean-up cycles. This embodiment does not depend upon a connection with a powertrain control or engine control module. Pump motor 30 is driven by a DC-DC converter system 50 that receives system voltage (i.e., the regulated voltage from the voltage regulator such as 14 volts). A converter circuit 51 which may comprise an integrated circuit has an input receiving the system voltage and an output for providing either an operating voltage (e.g., 12 volts) or a boost voltage (e.g., 18 volts) to pump motor 30. Converter circuit 51 has a SELECT input receiving a control signal from a controller 52. Controller 52 receives the system voltage in order to be able to detect the key-on status of the vehicle and to coordinate the occurrence of a clean-up cycle or cycles during a particular driving cycle. For example, a clean-up cycle may be conducted at a fixed time interval after the key-on signal is received. A clean-up cycle could be conducted a few seconds after receiving system voltage or could be a longer delay in order to wait until engine operation and the electrical system voltage have stabilized. Alternatively, the clean-up cycle could be initiated at key-off when the system voltage drops back to zero, provided there is sufficient stored energy in the DC-DC converter or provision is made to provide additional power to the DC-DC converter. System voltage may typically be provided through a fuel pump relay as is known in the art.

The pump motor of the present invention may be sized for efficient operation at the normal operating voltage of the vehicle electrical system. For example, the pump motor may be run directly off of the vehicle system voltage so that the DC-DC converter is only activated during the clean-up cycle in order to provide the boost voltage. Therefore, the pump motor design may be optimized for its ordinary run cycle. Nevertheless, the pump motor may be safely operated at a boost voltage greater than the motor's nominal voltage rating by limiting the time of the clean-up cycles by any suitable method including but not limited to the methods shown herein.

What is claimed is:

1. A fuel pump system for pumping fuel to an engine in a vehicle, comprising:

a pump motor including a carbon-based commutator and brushes in a position exposed to said fuel resulting in a film forming between said commutator and brushes, wherein said pump motor has a nominal voltage rating;

a power circuit coupled to said pump motor for selectable providing an operating voltage and a boost voltage, wherein said boost voltage is greater than said nominal voltage rating; and a controller for selecting said operating voltage during an ordinary run cycle and selecting said boost voltage during a clean-up cycle, wherein said controller selects said clean-up cycle for a limited time that is sufficiently short to avoid damage to said pump motor from exceeding said nominal voltage rating and sufficiently long to create arcing between said commutator and brushes that reverses formation of said film.

2. The fuel pump system of claim 1 wherein said vehicle includes an electrical system providing a regulated voltage and wherein said nominal voltage rating is substantially equal to said regulated voltage.

3. The fuel pump system of claim 1 wherein said vehicle includes an electrical system providing a regulated voltage of about 14 volts and wherein said boost voltage is equal to about 18 volts.

4. The fuel pump system of claim 1 wherein said limited time for said clean-up cycle comprises a total time of less than or equal to about 90 seconds during a period of 24 hours.

5. The fuel pump system of claim 1 wherein said limited time for said clean-up cycle comprises repeated periods less than about 10 seconds each.

6. The fuel pump system of claim 5 wherein said controller includes an accumulator for accumulating said repeated periods, and wherein said controller no longer selects said clean-up cycle during a predetermined interval after said accumulator reaches a predetermined maximum.

7. The fuel pump system of claim 1 wherein said limited time period occurs during acceleration of said vehicle in order to mask noise produced when operating said pump motor at said boost voltage.

8. The fuel pump system of claim 7 wherein said controller is integrated with a controller of said engine in order to detect said acceleration.

9. The fuel pump system of claim 1 wherein said vehicle includes an ignition switch activated by a vehicle operator, wherein said controller is integrated with said power circuit, and wherein said clean-up cycle is initiated in response to activation of said ignition switch.

10. The fuel pump of claim 1 wherein said power circuit comprises a DC-to-DC converter.

11. A method of operating a pump motor in a fuel system delivering fuel to an engine of a vehicle, wherein said pump motor includes a carbon-based commutator and brushes in a position exposed to said fuel resulting in a film forming between said commutator and brushes, and wherein said pump motor has a nominal voltage rating, said method comprising the steps of:

supplying an operating voltage to said pump motor during an ordinary run cycle, wherein said operating voltage is less than or equal to about said nominal voltage rating; and supplying a boost voltage to said pump motor during a clean-up cycle, wherein said boost voltage is greater than said nominal voltage rating, and wherein said clean-up cycle is sufficiently short to avoid damage to said pump motor from exceeding said nominal voltage rating and sufficiently long to create arcing between said commutator and brushes that reverses formation of said film.

12. The method of claim 11 wherein said clean-up cycle comprises a total time of less than or equal to about 90 seconds during a period of 24 hours.

13. The method of claim 11 wherein said clean-up cycle comprises repeated periods less than about 10 seconds each.

14. The method of claim 13 further comprising the steps of:

accumulating said repeated periods using an accumulator, and suspending said clean-up cycle during a predetermined interval after said accumulator reaches a predetermined maximum.

15. The method of claim 11 further comprising the steps of:

detecting an acceleration event of said vehicle; and switching from said ordinary run cycle to said clean-up cycle during said acceleration event in order to mask noise produced when operating said pump motor at said boost voltage.

16. The method of claim 15 wherein said acceleration event is detected by a powertrain control module.

17. The method of claim 11 wherein said vehicle includes an ignition switch activated by a vehicle operator, and wherein said clean-up cycle is initiated in response to activation of said ignition switch.

* * * * *